US005184807A

United States Patent [19]

Nikolov et al.

[11] Patent Number: 5,184,807

[45] Date of Patent: Feb. 9, 1993

[54] ELECTRIC HOIST INCLUDING A PLANETARY REDUCTION GEAR HOUSING DISPOSED WITHIN A HOIST DRUM

[75] Inventors: Nikolay N. Nikolov, Sofia; Nikolay T. Tzanev; Pavlin S. Pavlov, both of Gabrovo, all of Bulgaria

[73] Assignee: DF Podem, Gabrovo, Bulgaria

[21] Appl. No.: 780,448

[22] Filed: Oct. 22, 1991

Related U.S. Application Data

[63] Continuation of Ser. No. 467,089, Jan. 18, 1990, abandoned.

[51] Int. Cl.[5] ..... B66D 1/22

[52] U.S. Cl. ..... 254/344; 254/362

[58] Field of Search ..... 254/344, 346, 362

[56] References Cited

U.S. PATENT DOCUMENTS 2,966,068 12/1960 Christian ..... 254/344
3,460,807 8/1969 Prikhodko et al. ..... 254/344
3,850,411 11/1974 Vavilov et al. ..... 254/344

FOREIGN PATENT DOCUMENTS 2601244 7/1977 Fed. Rep. of Germany .
1571094 7/1980 United Kingdom .
2129397 5/1984 United Kingdom ..... 254/344

*Primary Examiner*—Daniel P. Stodola
*Assistant Examiner*—Tony A. Gayoso
*Attorney, Agent, or Firm*—Michael G. Marinangeli; Thomas A. Gallagher

[57] ABSTRACT

An electric hoist which includes a drum mounted in a carrying frame, and an electric motor mounted on one end face of the carrying frame, and connected kinematically to a planetary reduction gear, whose housing is disposed totally inside the drum. The housing is connected to the drum by a gear diaphragm and a gear ring. The carrying frame is connected by a connecting shaft and spline joints to the output shaft of a stem, and the gear ring is shaped as an integral part of the drum.

2 Claims, 1 Drawing Sheet

ELECTRIC HOIST INCLUDING A PLANETARY REDUCTION GEAR HOUSING DISPOSED WITHIN A HOIST DRUM

This is a continuation of application Ser. No. 467,089 filed Jan. 18, 1990, now abandoned.

FIELD OF THE INVENTION

This invention relates to an electric hoist which can be used in material handling machines.

BACKGROUND OF THE INVENTION

Already known is a drum drive for, a cable which comprises a planetary reduction gear disposed inside a housing, connected to an electric motor disposed in front of the face of a drum mounted on a carrying frame itself connected to the planetary reduction gear by means of a stem at its last stage. The housing is fastened to the drum by means of flanges (See GFR Patent Specification No. 26 01 244, Int. Pat. Cl. 4 B 66 D1/1).

The drawbacks of this known drive are its comparatively low reliability resulting from the rigid connection with the planetary reduction gear, an d in the necessity of overdimensioning the drum required by the means for the transmitting of the torque from the electric motor to the first stage of the planetary reduction gear.

OBJECT AND SUMMARY OF THE INVENTION

An object of this invention is to develop an electric hoist with increased reliability of the drum drive and with a design with reduced specific consumption of metals.

Other objects will in part be obvious or will appear from the following description and accompanying drawings These objects are achieved by an electric hoist comprising a drum, seated in a carrying frame, with an electric motor mounted in front of the face of the carrying frame and connected kinematically to a planetary reduction gear, whose housing is disposed totally inside the drum. According to the invention, the housing is connected to the drum by a gear diaphragm and a gear ring. The carrying frame is connected by means of a connecting shaft and spline joints to the hub of a stem, and the gear ring is shaped as an integral part of the drum.

The advantages of the electric hoist according to the invention lie in its increased reliability, resulting from the elastic connection between the hub and the carrying frame by means of a connecting shaft, as well as in the reduced overall sizes of the drum, resulting from the kinematic connection between the shaft of the electric motor and the first stage of the planetary reduction gear.

BRIEF DESCRIPTION OF THE DRAWING

For a better understanding of the invention, reference is made to the accompanying drawing in which there is shown a partial cross-sectional view of an electric hoist according to the invention.

DISCLOSURE OF BEST MODE OF THE INVENTION

Figure 1:
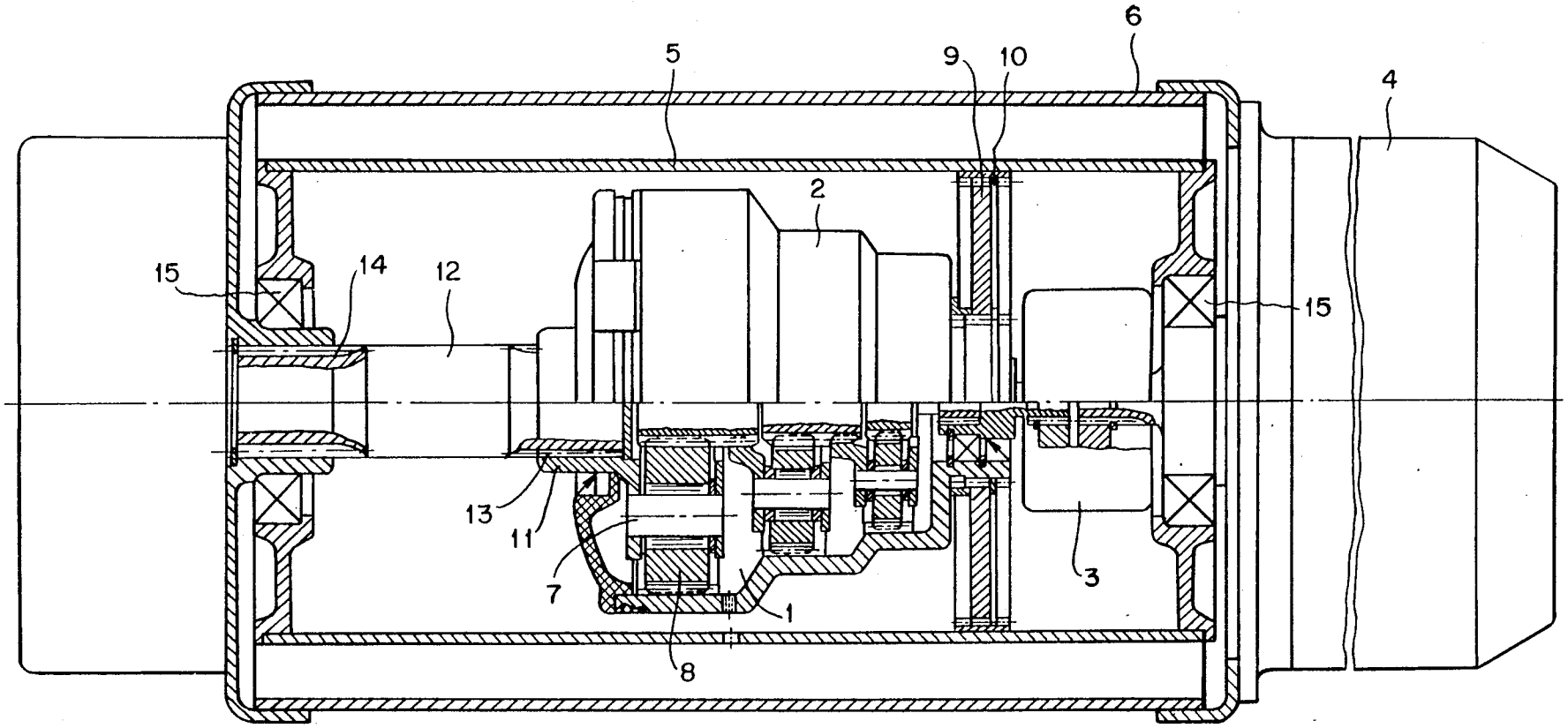

According to the invention an electric hoist comprises a planetary reduction gear 1 which is disposed inside a housing 2, connected by means of a clutch 3 to an electric motor 4 disposed in front of the face side of the drum 5, seated in the carrying frame 6. This carrying frame 6 is connected to the planetary reduction gear 1 by means of the stem 7 of the last planetary stage 8 most distant from motor 4. The housing 2 inside drum 5 is connected to the drum 5 by means of gear diaphragm 9 and gear ring 10. By means of hub 11, connecting shaft 12 and spline joints 13 and 14, the stem 7 is connected to the carrying frame 6. Gear ring 10 is shaped as an integral part of the drum 5, which is seated by means of bearing 15 in carrying frame 6.

The electric hoist according to the invention operates as follows:

The torque of the electric motor 4 is transmitted by clutch 3 and the stages cf planetary reduction gear 1 to housing 2 and, from there, by gear diaphragm 9 to gear ring 10. Since stem 7 is connected by means of spline joints 13 and 14 and connecting shaft 12 to carrying frame 6, drum 5 receives a smooth rotational motion.

The device of the invention has been thoroughly tested under actual use conditions and has been found to be completely successful for the accomplishment of the above-stated objects of the present invention.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention, as claimed, may be resorted to in actual practice, if desired.

Having thus described the invention, what is claimed as new and to be secured by Letters Patent is:

1. An electric hoist comprising a drum mounted inside a carrying frame; an electric motor mounted on said carrying frame, a planetary reduction gear coaxially mounted in said drum; said motor having a drive shaft and clutch which are coaxially connected to said planetary gear; said planetary gear being mounted in a housing; said housing having a pair oppositely axially projecting stems; a first one of said pair of stems forming a hub of said planetary gear and being connected to said carrying frame by means of a connecting shaft and a pair of spline joints; said second one of said pair of stems forming a support for a gear diaphragm; a gear ring forming an integral part of said drum; and said gear diaphragm and gear ring drivingly connecting said planetary gear to said drum.

2. The electric hoist as claimed in claim 1 wherein said gear diaphragm and gear ring have respectively exterior and interior annular confronting surfaces which are serrated to form a two-sided gear connection.

* * * * *